United States Patent [19]

Tarlow, Jr.

[11] Patent Number: 4,772,013

[45] Date of Patent: Sep. 20, 1988

[54] ROWING EXERCISE MACHINE

[76] Inventor: Elliot S. Tarlow, Jr., 80 Litchfield St., Suite 9, Brighton, Mass. 02135

[21] Appl. No.: 806,760

[22] Filed: Dec. 9, 1985

[51] Int. Cl.[4] ..... A63B 69/06

[52] U.S. Cl. ..... 272/72

[58] Field of Search ..... 272/72, 128, 121, 126, 272/132, 133, 134

[56] References Cited

U.S. PATENT DOCUMENTS

| | | | |
|---|---|---|---|
| 3,572,700 | 3/1971 | Mastropaolo | 272/132 |
| 4,396,188 | 8/1983 | Dreissigacker et al. | 272/128 |

FOREIGN PATENT DOCUMENTS

| | | | |
|---|---|---|---|
| 1183559 | 3/1985 | Canada | 272/72 |
| 0389682 | 3/1933 | United Kingdom | 272/72 |
| 1085606 | 4/1984 | U.S.S.R. | 272/72 |

*Primary Examiner*—Richard J. Apley
*Assistant Examiner*—S. R. Crow
*Attorney, Agent, or Firm*—Robert E. Ross

[57] ABSTRACT

A rowing exercise machine of the type in which a wheel with air paddles is rotated by an operator by pulling on a pull bar attached to a chain which extends around gears on the wheel axle, while sitting on a seat which rolls back and forth on a support beam. To return the chain after a rearward simulated rowing stroke, a rope is attached at each end to the outer end of the pull bar, and extends rearwardly around suitably positioned pulleys to connect with the end of the chain opposite the end which is attached to the pull bar. In a preferred embodiment of the invention the rope is passed through an eye at the end of the chain so that it can pass freely therethrough, allowing adjustment of the angle of the pull bar.

6 Claims, 3 Drawing Sheets

ROWING EXERCISE MACHINE

BACKGROUND OF THE INVENTION

In U.S. Pat. No. 4,396,188, issued Aug. 2, 1983, there is illustrated an exercise machine of the rowing type in which the operator rolls back and forth on a seat mounted on a main support beam. On rear movement, the operator pulls on a pull bar attached to a chain, which extends around gears on the wheel axle, rotating the wheel. Resistance to rotation is provided by air paddles mounted on the wheel. The end of the chain opposite to the end attached to the pull bar is attached to a spring, which extends when the chain is pulled. Therefore on the forward return stroke, the extended spring contracts to assist in pulling the pull bar forwardly. Although the sensation provided by the machine on the pulling stroke is similar to that of an actual rowing stroke, the assistance provided by the machine on the forward stroke provides a sensation which is completely different from that of the sensation during the return of an oar during actual rowing, since it pulls the arms and upper body of the operator forwardly, whereas in actual rowing, the rower must push the oar handle forwardly against the resistance of the wind on the oar blade and the friction of the oar lock, which requires a positive forward force to move the oar back to the forward position in preparation for another rowing stroke.

SUMMARY OF THE INVENTION

This invention provides an exercise rowing machine of the type described in which means is provided attached to the pull bar for returning the drive chain to the forward position on the forward stroke without the use of spring means to pull the bar and chain forwardly, and therefore requiring effort on the part of the operator. In a preferred embodiment of the invention, the end of the chain opposite to the end attached to the pull bar extends into the front end of the support beam on which the seat is supported. Said end is attached to the medial portion of a rope, the ends of which extend out of the rear end of the beam to suitably positioned pulleys and then forwardly to the outer ends of the pull bar. On the rearward motion of the pull bar, the chain pulls the rope ends forwardly as the pull bar moves rearwardly, and on the forward movement of the pull bar, the pull bar pulls the ends of the rope forwardly, thereby pulling the chain rearwardly in the support beam. The effort required to push the pull bar back to the forward position closely simulates the feel of returning an oar to the forward position during actual rowing. In a preferred embodiment of the invention, the medial portion of the rope passes freely through an eye at the end of the chain, so that the rope can move through the eye to allow adjustment of the angle of the pull bar to the desired position in relation to the operator.

The pulleys used to direct the rope from the ends of the pull bars into the end of the beam may conveniently be positioned on outwardly inclined support members at the rear end of the beam.

DESCRIPTION OF THE ILLUSTRATED EMBODIMENT

Figure 1:
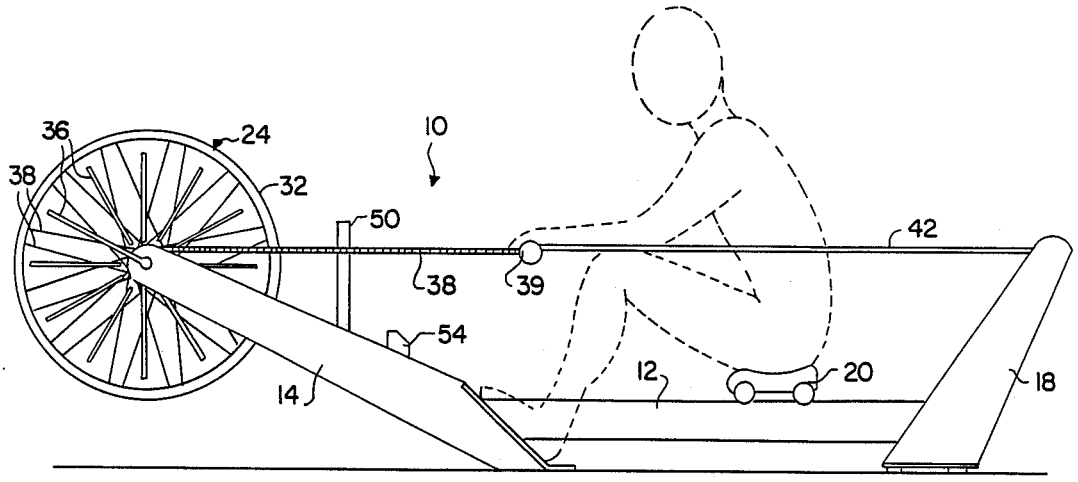
FIG. 1 is view in side elevation of a rowing exercise machine embodying the features of the invention, in which the operator is in the forward position in preparation for a simulated rowing stoke.
Figure 2:
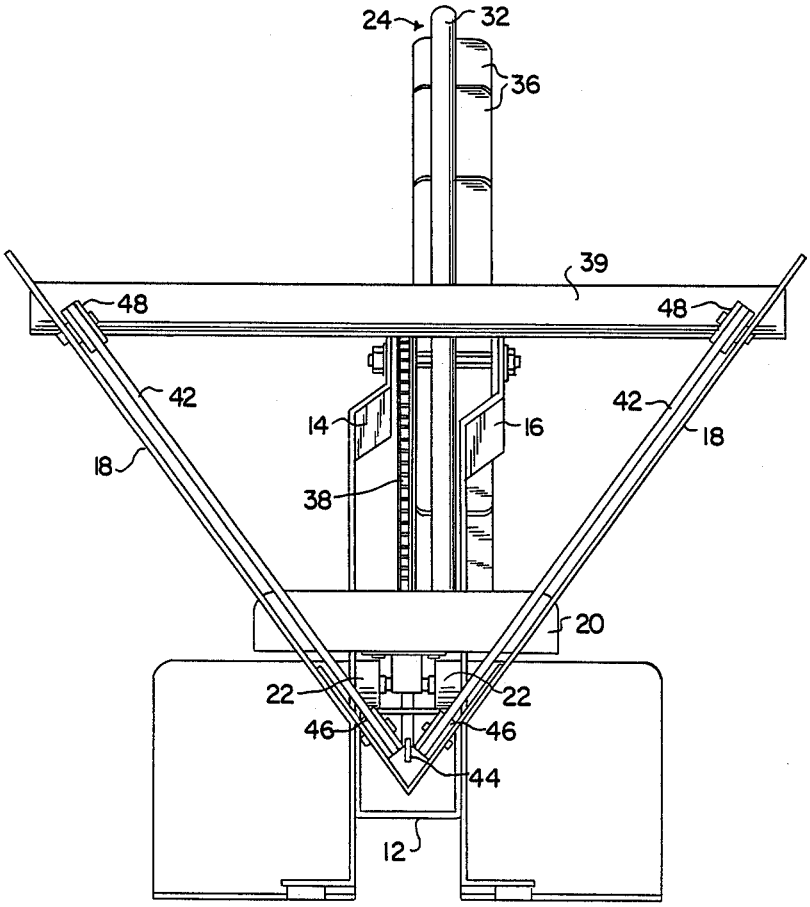
FIG. 2 is a view of the rowing machine of FIG. 1 as seen from the right or rear end.
Figure 3:
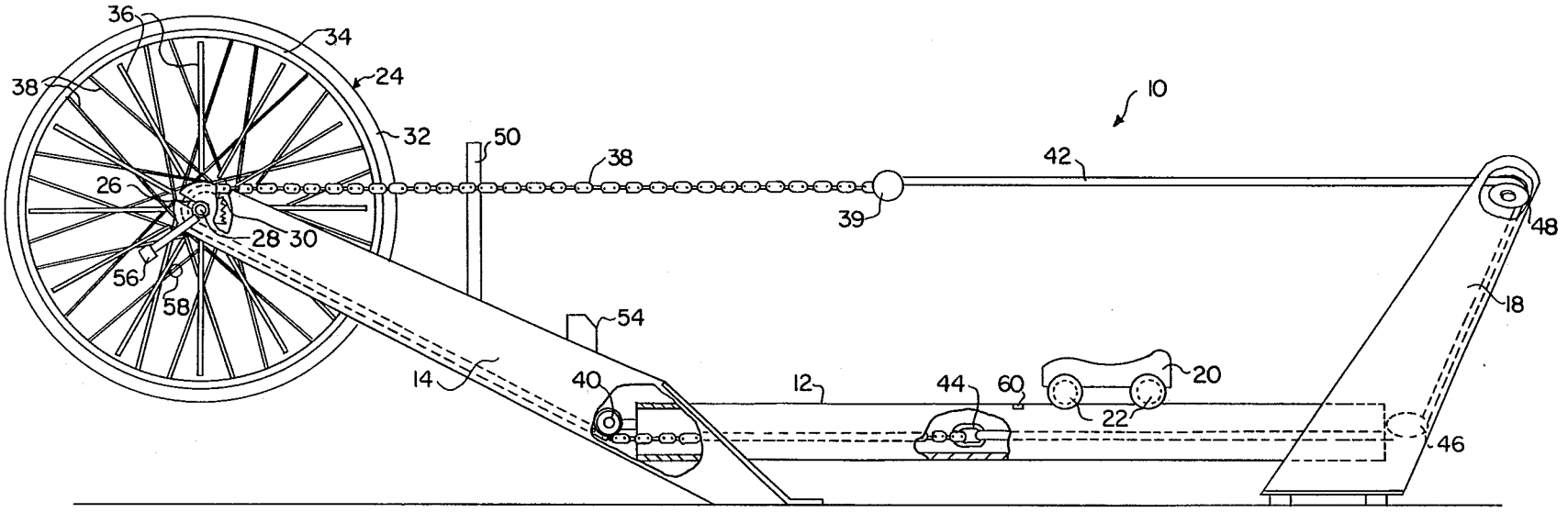
FIG. 3 is a view of the rowing machine as illustrated in FIG. 1, partly in section.
Figure 4:
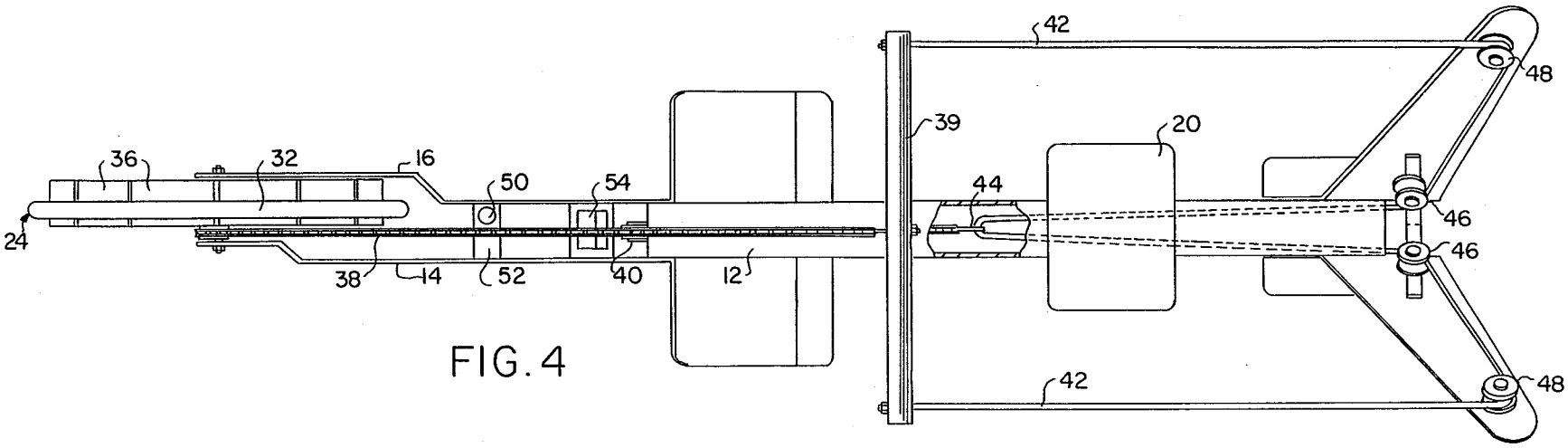
FIG. 4 is a top plan view of the machine as illustrated in FIG. 3.

Referring to the drawing, there is illustrated a rowing exercise machine 10, which comprises a main support beam 12, a pair of forward arms 14 and 16 attached to the front end of the beam and extending forwardly and upwardly therefrom, and a pair of rear arms 18 extending upwardly and outwardly and rearwardly from the rear end of the beam.

A seat 20 is provided suitable rollers 22 to enable the seat to roll back and forth on the beam.

A wheel 24 is mounted between the arms 14 and 16 at the forward end thereof in any convenient manner, such as by providing slots 26, 28 in the forward ends of the arms. The wheel may be an ordinary bicycle wheel, having an axle 28, gears 30, and a tire 32 assembled onto the rim 34. To provide resistance to rotation, air paddles 36 are assembled into the spokes 38 of the wheel, and to provide additional inertia to the wheel, the tire may be filled with water instead of air.

To enable rotation of the wheel 24 by an operator of the machine, a chain 38 is provided, which is provided with a pull bar 39 at one end, and extends from the pull bar forwardly around the gears 30, downwardly and rearwardly around an idler pulley 40 positioned between the arms 14 and 16, and then rearwardly into the beam 12.

To provide means for returning the chain to the forward position (as seen in FIG. 1) after a rearward rowing stroke, a cord or rope 42 is provided which is connected between the end of the chain in the beam and the ends of the pull bar in a manner now to be described. The end of the chain in the beam is provided with an eye 44. The medial portion of the rope is disposed in the eye, and the two ends of the rope 42 extend rearwardly in the beam to pulleys 46 suitably positioned at the end of the beam, around said pulleys 46 to a second set of pulleys 48 on the upper ends of the rear arms, and then forwardly to terminate at the outer ends of the pull bar 39.

The rope is tightened at one or both ends of the pull bar so that the chain-rope system has enough tension to maintain the pull bar at a suitable height for grasping by the operator of the machine, as illustrated in FIG. 1. In normal operation, if the chain-rope system is too loose, it may be conveniently tightened by pulling one end of the rope more tightly at either end of the pull bar. This tends to leave the pull bar positioned at an undesirable angle to the operator, however the position of the pull bar may be easily adjusted by the operator by manual manipulation, since the rope can pass freely through the eye at the end of the chain to allow such adjustment.

During operation of the device, the operator sits on the seat 20, and at the beginning of a simulated oar stroke, assumes the position as illustrated in FIG. 1. During the rearward stroke, the operator straightens his legs, causing the seat to roll rearwardly along the beam 12, while pulling the pull bar 39. As the pull bar and chain move rearwardly, the chain, by engagement with the gears 30, causes the wheel to spin.

As the chain moves around the gears, the end of the chain in the beam moves forwardly, pulling the two rope portions around pulleys 46 and 48, and the extreme ends of the two rope portions, being attached to the pull bar, move rearwardly with the pull bar.

Figure 5:
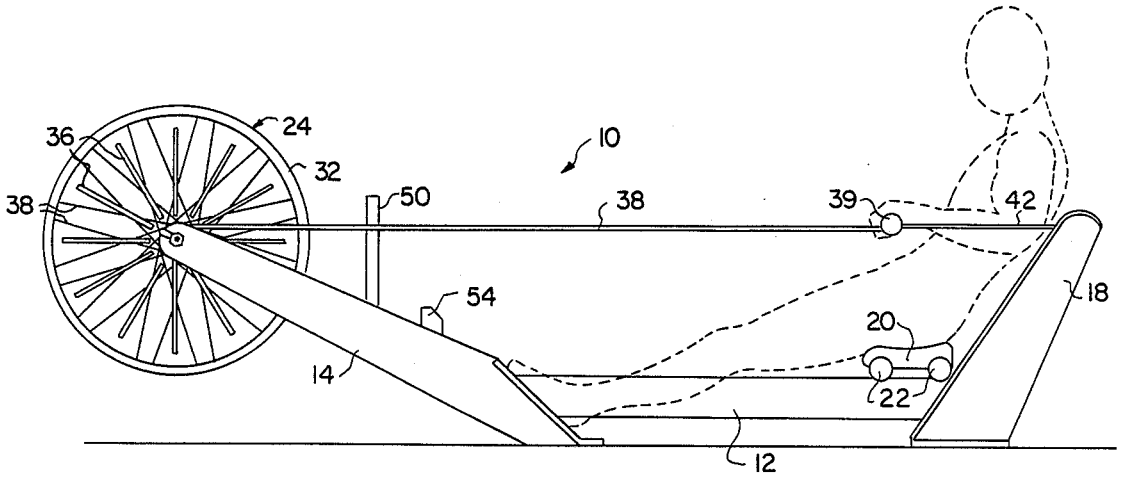
FIG. 5 is a view similar to FIG. 1 in which the operator is at the end of a simulated rowing stroke.

At the end of the rearward rowing stroke, the operator has assumed a position as shown in FIG. 5, with his legs straightened and the pull bar against his chest. On the return stroke, the operator rolls forwardly on the beam, pushing the pull bar as he returns, which pulls the rope end portions forwardly around the pulleys and pulls the end of the chain in the beam rearwardly to the original position. Such forward movement of the pull bar requires the expenditure of some small amount of energy by the operator, and closely simulates the energy required to return an actual oar to its original position in preparation for another rowing stroke, and therefore the entire cycle of operation more closely simulates the sensation of actual rowing than does previous devices of this type.

It will be noted that the plane of the wheel 24 is offset to the right (as seen by the operator) from the centerline of the beam, to enable the gears 30 to be on the beam centerline, so that the line of pull of the operator is along the beam centerline. This may be accomplished by providing the forward arms 14, 16, with an offset portion at the outer end, or by providing a spacing member on the outer end of the left arm 14 and a spacing member between the right arm 16 and the beam 12.

Although in the illustrated embodiment a bicycle wheel with air paddles for aerodynamic braking is provided at the front of the arms, it will be understood that other types of wheels, such as a wheel formed of sheet metal with integral air paddles may be used. Also, energy absorbing braking means other than air paddles may be used, such as electromagnetic braking. However aerodynamic braking arranged so that it causes movement of air over the operator is preferred.

Certain other features of the machine will now be described. A chain guide post 50 is mounted on a plate 52 which connects the forward arms 14, 16, and is positioned so as to prevent the chain 38 from contacting the wheel or the air paddles during operation. The post 52 also serves as a stop to limit the distance the pull bar can move forwardly. A computer 54 may be mounted on a forward arm to provide information on speed of rotation of the wheel, the stroke rate, elapsed time, and any other desired information. Information may be supplied to the computer from a pick-up 56 mounted near the wheel, with a magnet 56 or other device mounted on the wheel to provide a signal to the pick-up on each revolution. Another pick-up may be provided on the beam to detect the passage of the seat, to provide information on the stroke rate. A suitable divide-by-two circuit may be provided in the computer to provide accurate stroke rate information.

Although the illustrated embodiment of the invention is a machine to simulate a rowing operation, it will be understood that certain aspects of the invention may be adapted for use with other types of exercise devices.

Since certain obvious modifications may be made in the illustrated embodiment of the invention without departing from the scope thereof, it is intended that all matter contained herein shall be interpreted in an illustrative and not a limiting sense.

I claim:

1. An exercise machine comprising a rotatable member having drive means associated therewith which drives the rotatable member when rotated in one direction and free wheels when rotated in the other direction, elongated flexible means disposed around the drive means and having a handle attached to an end of the elongated flexible means such that the rotatable member rotates when the handle is pulled away from the drive means from a first position to a second position, and means for thereafter pulling the elongated flexible member back to the first position, said means comprising a second elongated flexible member having one end portion attached to the handle and the other end portion attached to the end of the chain opposite the handle, and means between said ends for reversing the direction of said elongated flexible elongated member, said second elongated flexible member comprising a rope and said other end thereof comprises a rope medial portion which extends through an eye in the end of the first elongated flexible means opposite the handle, and the other end portion of the rope comprises a pair of rope ends which are attached to the handle in lateral spaced relation to each other and means is provided for reversing the direction of said ends.

2. An exercise machine which simulates rowing, said machine comprising a wheel, wheel rotation means including a chain and a pull-bar attached to one end of the chain, said chain being so associated with the wheel that when one end of the chain is pulled away from the wheel by the pull-bar from a first position to a second position, the wheel rotates; chain return means attached at one end to the other end of the chain and at the other end to the pull-bar, and extending around suitable pulleys so arranged that forward motion of the pull-bar causes said return means to pull the chain from the second position back to the first position, said one end of the chain being attached to the center of the pull-bar and said chain return means comprising a rop attched at a medial portion to said other end of the chain, said rope having two end portions extending around direction reversing means and being attached to the opposite end portions of the pull bar.

3. An exercise machine as set out in claim 2 in which said other end of the chain has an eye and said medial portion of the rope extends through the eye and is freely movable therethrough.

4. An exercise machine which simulates rowing, said machine comprising a hollow main beam, means at the forward end of the beam for supporting a wheel having gears which rotate the wheel when rotated in one direction and free wheel when rotated in the other direction, means guiding a wheel rotating chain extending around the gears from above the beam into the forward end of the beam, and pulley means at the rear end of the beam positioned to direct two ropes attached to an end of the chain in the beam from out of the rear end of the beam forwardly to a position above the beam, whereby a pull bar attached to the chain above the beam and to the forwardly extending ropes, will, when moved rearwardly to simulate a rowing stroke, pull the portion of the chain above the beam rearwardly, rotate the wheel, and pull the portion of the chain and the ropes in the beam forwardly in the beam, and when the pull bar is thereafter moved forwardly, will pull the portion of the chain and ropes in the beam rearwardly in the beam so that the portion of the chain above the beam is pulled back to the original position.

5. An exercise machine as set out in claim 4 which comprises a wheel rotating chain which is attached to the medial portion of a pull bar and has a rope attached at a rope medial portion to the end of the chain in the beam, said rope having ends extending from the rop medial portion into attachment with the outer end portions of the pull bar, whereby sufficient tension applied to the rope ends will maintain the pull bar at an elevation above the beam and generally on a line between the gears and the pulley means.

6. An exercise machine as set out in claim 5 in which the end of the chain in the beam has an eye through which the medial portion of the rope extends, whereby the angle of the pull bar may be readily adjusted by causing the rope to move through the eye.

* * * * *